US005445316A

United States Patent [19]

Roccaforte

[11] Patent Number: 5,445,316

[45] Date of Patent: Aug. 29, 1995

[54] SIFT PROOF AND TAMPER EVIDENT POURING SPOUT

[75] Inventor: Harry I. Roccaforte, Chicago, Ill.

[73] Assignee: Waldorf Corporation, St. Paul, Minn.

[21] Appl. No.: 247,648

[22] Filed: May 23, 1994

[51] Int. Cl.[6] ..... B65D 5/74

[52] U.S. Cl. ..... 229/215; 229/207; 229/219

[58] Field of Search ..... 229/207, 215, 217, 219

[56] References Cited

U.S. PATENT DOCUMENTS

| | | | |
|---|---|---|---|
| 1,539,985 | 6/1925 | Allen . | |
| 1,907,939 | 5/1933 | Venning et al. . | |
| 2,019,943 | 11/1935 | Venning et al. . | |
| 2,701,678 | 2/1955 | Read . | |
| 2,701,679 | 2/1955 | Goldstein . | |
| 2,742,220 | 4/1956 | Lynes . | |
| 2,760,708 | 8/1956 | Phillips | 229/215 |
| 2,819,832 | 1/1958 | Stoller et al. . | |
| 3,226,003 | 12/1965 | Hickin | 229/215 |
| 3,346,165 | 10/1967 | Koolnis . | |
| 3,395,848 | 8/1968 | Johnson . | |
| 3,568,910 | 3/1971 | McConnell . | |
| 4,150,778 | 4/1979 | Engdahl, Jr. . | |
| 4,168,003 | 9/1979 | Wysocki . | |
| 4,194,677 | 3/1980 | Wysocki | 229/215 |
| 4,317,518 | 3/1982 | Mode | 229/207 |
| 4,569,443 | 2/1986 | Roccaforte . | |
| 4,909,395 | 3/1899 | Weissman . | |
| 4,944,406 | 7/1990 | Zehnal | 229/207 |
| 4,989,735 | 2/1991 | O'Brien . | |
| 5,007,542 | 4/1991 | Roccaforte . | |
| 5,035,330 | 7/1991 | Kuchenbecker | 229/207 |
| 5,110,042 | 5/1992 | Hurden | 229/215 |
| 5,215,250 | 6/1993 | Roccaforte . | |
| 5,316,212 | 5/1994 | Eriksson et al. | 229/215 |

FOREIGN PATENT DOCUMENTS 546884 10/1957 Canada .

*Primary Examiner*—Gary E. Elkins

*Attorney, Agent, or Firm*—Schwegman, Lundberg & Woessner

[57] ABSTRACT

A substantially sift proof pouring spout is provided by cooperating interior and exterior pouring spout components formed by partial throughcuts, edges or lines of perforations. The exterior spout component is split to form an automatic supplemental side wing, includes an integral inward travel stop tab, and is releasably connected to a tamper evidence tab. The invention encompasses a single-piece flat blank for forming the spout and a carton with which it is integrated. The inward travel stop tab and tamper evidence tab are defined at least in part by the partial cuts and resultant delamination areas.

33 Claims, 6 Drawing Sheets

SIFT PROOF AND TAMPER EVIDENT POURING SPOUT

TECHNICAL FIELD

The present invention relates to paperboard cartons. More particularly, it relates to pouring spouts for paperboard cartons wherein the spout is integrated with the carton, is useful with cartons having a relatively small or narrow width or thickness, is "sift proof" to protect the contents and prevent leakage, and provides evidence of tampering.

BACKGROUND OF THE INVENTION

U.S. Pat. Nos. 4,569,443 and 5,215,250 address many of the problems associated with pouring spout structures for paperboard cartons. However, one problem unsolved by the cartons of the two patents is how to provide optimal barrier protection for the material contained in a carton with a pouring spout, while at the same time providing a pouring spout that is easy for a consumer to open.

Typically, cartons with pouring spouts for containing hygroscopic material or particulate materials requiring a degree of barrier protection are adapted to prevent the absorption of moisture or other contaminants by having, for example, films or other coatings applied to or integrated with the carton walls. Sifting or leakage from pouring spout containers can be a particular problem, because the spout structure generally includes aligned or overlaid seams, edges, cuts or perforated lines. Cuts that penetrate completely through the carton walls are a particular problem, especially if the contents are in direct contact with the cuts and the cuts provide a pathway directly to the exterior of the carton.

U.S. Pat. Nos. 4,732,315; 4,718,557; 3,346,165; and 2,819,832 are representative of attempts to solve the barrier protection and leakage problems. The latter patent discloses a leak-proof carton with superimposed inside and outside spout openings. However, when such double perforated flap structures are used, the material contained in the carton may still leak out and moisture may still easily penetrate the carton, particularly when perforations and throughcuts in separate layers are adjacent or superimposed along their length.

U.S. Pat. No. 4,909,395 discloses a carton having a double panel end closure with an opening flap in the outer panel providing access to a dispensing aperture in an inner panel. The opening structure includes a partially pre-cut bridge in an adhesive area for securing the outer opening flap to the inner panel, but again, aligned cuts or cuts that run from the carton exterior to the inner opening can provide a path for moisture entry.

It is well recognized that it is desirable to have an opening structure that can provide evidence of attempted or actual tampering. In this regard, U.S. Pat. No. 4,569,443 discloses a carton with a pouring spout and a removable access tab that provides a means for determining whether tampering has occurred. U.S. Pat. Nos. 3,395,848; 4,706,875 and 4,799,594 all disclose recloseable opening and dispensing structures for cartons in which perforations or other lines of weakness are used to form a portion of the structure to help provide evidence of tampering if they appear to have been torn.

Another problem in cartons with pouring spouts is that the spout or carton may be damaged or rendered useless by pulling the spout too far out while opening it or forcing it inwardly too far into the carton interior when reclosing it. This problem is partially addressed in U.S. Pat. No. 5,215,250, wherein a spout structure includes wings for forming the sides of the spout and for guiding the outward travel of the spout. Another portion of the spout acts as a stop to prevent the spout from being pushed inadvertently into the carton interior. However, as mentioned above, the disclosed spout does not adequately address the problem of barrier protection and resistance to leaking, nor does it include positive stop features for controlling the inward and outward movement of the spout.

Clearly, despite the improvements described in the above-cited patents, there is a need for a carton including a durable, integral dispensing spout structure for powdered or granular materials that prevents leakage and provides barrier protection for the contents, while at the same time providing tamper evidence and easy opening.

SUMMARY OF THE INVENTION

The present invention overcomes the problems unaddressed by known cartons with pouring spout structures and provides a sift proof carton with a pouring spout with complete side walls, a tamper evidence feature and control of the inward and outward movement of the spout structure during opening and closing. It further provides a carton that can be produced in a rapid, efficient and economical manner.

A substantially sift proof pouring spout carton is provided by the carton body and cooperating interior and exterior pouring spout components formed in part by cuts partially penetrating the thickness of the material from which the carton is formed, free edges or lines of perforations, none of which are aligned and overlaid along their length. The exterior spout component is split to form an automatic supplemental side wing, includes an integral inward travel stop tab, and is releasably connected to a tamper evidence tab formed in the carton body. The inward travel stop tab and tamper evidence tab are defined at least in part by cuts partially penetrating the carton body and resultant delamination areas.

The invention encompasses a single-piece flat blank for forming the spout and carton with which it is integrated. The carton includes first and second side wall panels, first and second end wall panels hingedly connected to the first and second side wall panels, and top and bottom closure panels attached to the side wall panels to form a tubular carton having a rectangular cross-section. The pouring spout is formed integrally in one of the wall panels of the carton by the cooperating interior and exterior pouring spout components formed by die-cutting the blank. The carton and interior and exterior pouring spout components have no throughcuts, free edges or lines of perforations which are aligned and overlaid along their length and is, therefore, substantially sift proof.

It is an object of the present invention to provide a substantially sift proof paperboard carton, formed from a single-piece blank, having an integral pouring spout.

Another object of the present invention is to provide a pouring spout for a carton wherein the spout has full spout-forming side walls when deployed to its open, dispensing position, and includes an outward travel stop feature to control the outward movement of the spout.

Still another object of the present invention is to provide an integral pouring spout for a carton wherein the spout is recloseable and includes an inward travel stop to prevent a user from pushing it too far into the carton.

Yet another object of the present invention is to provide a carton with an integral pouring spout wherein the carton includes a tamper evidence feature adjacent to the spout to provide evidence of attempted or actual tampering.

An advantage of the pouring spout of the present invention is that it provides a recloseable pouring spout with complete spout sidewalls and inward and outward travel stops and a tamper evidence tab, yet is also substantially leak proof and provides significant barrier protection for the contents.

A feature of the present invention which accomplishes the advantage of significant barrier protection and leakage prevention are delamination regions formed in the carton adjacent to the pouring spout structure to provide the stops for controlling movement of the spout and the tamper evidence tab. A first delamination region is formed in the body of the carton adjacent to the spout and provides the inward travel stop associated with the spout, and a second delamination region is formed in the carton body adjacent to the spout to provide the tamper evidence tab of the present invention.

These and other objects, features and advantages of the present invention will become more fully apparent and understood with reference to the following specification, and to the appended drawings and claims.

DETAILED DESCRIPTION OF THE PREFERRED EMBODIMENT

Figure 1:
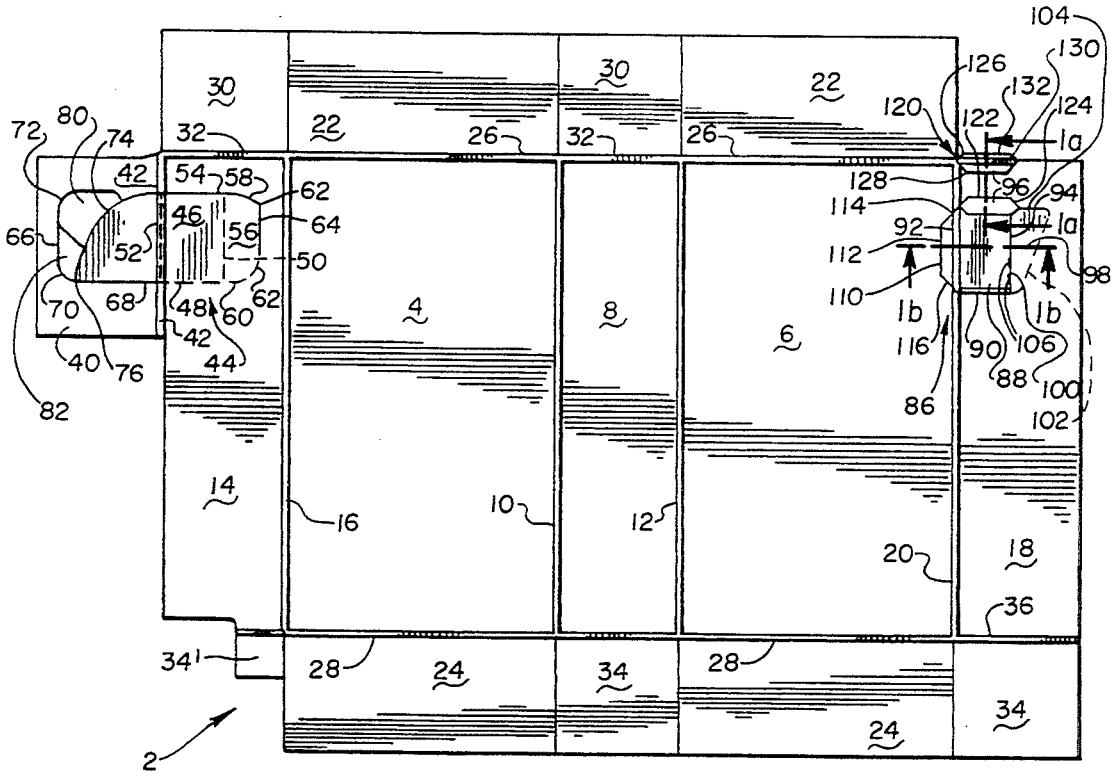
FIG. 1 is a plan view of the inside of the blank from which the carton of the present invention is formed and shows the die cut profile thereof.

FIG. 1 depicts a flat, single-piece paperboard blank 2 for forming a pouring spout carton (depicted fully erected in FIG. 6) in accordance with the present invention. The blank 2 may be formed from conventional paperboard or box board of any desired caliper, and is die-cut and scored as depicted by well-known, conventional methods. In all the Figures, double lines indicate fold score lines and single solid or dashed lines indicate cuts, partial cuts, or free edges.

Figure 6:
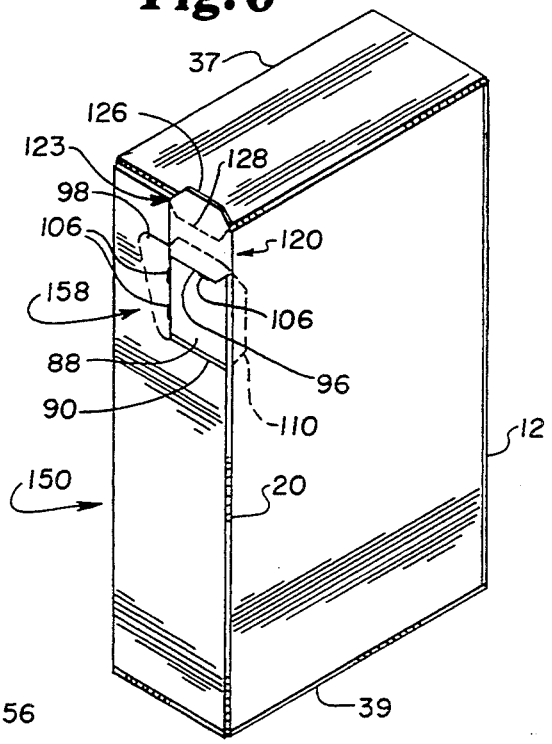
FIG. 6 is a perspective view showing the carton of the present invention folded up and closed, generally as it would appear when filled, sealed and ready for purchase by a consumer.

The blank 2 is cut and scored to define first and second main generally rectangular side wall panels 4, 6, respectively, a first end wall panel 8 between and hingedly connected to the side wall panels 4, 6 at parallel fold lines 10, 12, respectively. A glue flap 14 is hingedly connected to the remaining edge of the first side wall panel 4 at a fold line 16, and a second end wall panel 18 is hingedly connected at a fold line 20 to the remaining edge of the second side wall panel 6. Major top and bottom closure flap panels 22, 24, respectively, are hingedly attached to the side walls 4, 6 at fold lines 26, 28, respectively. Minor top closure flap panels 30 are hingedly connected to the end wall 8 and glue panel 14 at fold lines 32 generally collinear with fold line 26. Similarly, minor bottom closure flap panels 34 are foldably connected to the end wall panels 8, 18 at fold lines 36 collinear with the fold lines 28. A small glue receiving bottom closure tab 34' is foldably connected to the glue flap 14. The fold lines 26, 32 at the top of the blank 2 are generally collinear, perpendicular to the fold lines 10, 12, 16, 20 at the side edges of the main side and end wall panels and will form the top edge 37 of the carton (FIG. 6). Similarly, the fold lines 28, 36 at the bottom of the blank 2 are generally collinear, perpendicular to the fold lines 10, 12, 16, 20 and will form the bottom edge 39 of the carton (FIG. 6). Thus, the blank 2 will form a generally tubular carton of rectangular cross-section with closed ends when foldably erected.

A glue flap extension panel 40 is hingedly connected to the glue flap 14 at a fold line 42. An interior pouring spout component, indicated generally at 44, is formed in part in glue flap 14 and in part in the extension panel 40. The interior or inside pouring spout component 44 includes a generally rectangular center part 46 with a base hinge line 48, parallel side edges 50, 52 and a top free edge 54. One of the side edges, the edge 52, is collinear with and lies along the fold line 42 between the glue panel 14 and the extension panel 40. A first, generally rectangular, small spout side wall wing 56 is hingedly attached at one side 50 of the center part 46 and extends laterally away therefrom. The small wing 56 has upper and lower edges 58, 60, rounded corners 62 and a free side edge 64 parallel to the side edge 50. A second, larger spout side wall or wing 66 is hingedly attached to the other side 52 of the center part 46, and extends generally outwardly away therefrom in the plane of the blank 2. The larger spout wing 66 has a bottom edge 68 generally collinear with the base hinge edge 48 of the center portion 46, a rounded corner 70, a free side edge 72 generally parallel with the edge 52 of the center part 46 and an irregular upper edge 74. Immediately adjacent to the fold line 42, the upper edge 74 is collinear with the upper edge 54 of the center part, but then it curves sharply toward the edge bottom 68 to a V-shaped point 76. The upper edge 74 includes a straight portion adjacent to the edge 72 of the large wing 66 that extends at an angle from the point 76 to the outer edge 72 thus forming an outward travel stop lobe 82 for controlling the outward movement of the pouring spout of-the present invention. A stripped out area 80 is formed adjacent to the larger wing 66.

With continued reference to FIG. 1, the blank 2 includes an external or exterior pouring spout component, indicated generally at 86. The exterior pouring spout component is formed substantially in the second end wall 18 in the upper region thereof. The exterior pouring spout component 86 is split into at least two portions, including a generally rectangular exterior pouring spout center tab 88 having a hinge base 90, two parallel side edges 92, 94, and a top free edge 96. Although the center tab 88 will be generally rectangular in most cartons, other shapes (e.g., parallelogram, truncated pyramidal, trapezoidal) may be used as well. One of the side edges, edge 92, is collinear with the fold line 20 between the side wall 6 and the end wall 18. The external pouring spout component 86, particularly the center tab 88, is hingedly connected at its base 90 to the side wall 18.

The split or divided external pouring spout component of 86 includes a generally triangularly shaped exterior supplemental wing 98. The exterior wing 98 and the center tab 88 have a common side edge 100 formed by a single continuous incision cut entirely through the thickness of the blank 2 for forming the carton body. The wing 98 is hingedly connected to the end wall 18 along a hypotenuse edge formed by a perforated line 102. The remaining, uppermost edge of the wing 98 is defined by a single, continuous cut line 104 slightly offset with respect to the top free edge 96 of the center tab 88. The exterior pouring spout component 86 is held in place in the plane of the blank 2 (the side wall 18) by slight interruptions or nicks 106 in the cut line defining the side edge 100 of the center tab 88.

Figure 1A:
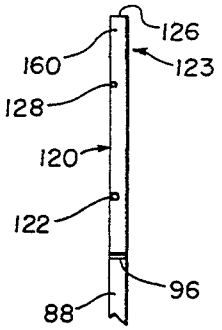
FIG. 1*a* is a cross sectional view taken along line 1*a*—1*a* in FIG. 1 and shows the partial cut bridge incisions defining, in part, the tamper evidencing tab of the present invention.
Figure 1B:
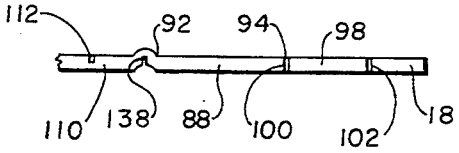
FIG. 1*b* is a cross sectional view taken along line 1*b*—1*b* in FIG. 1 and shows the partial cut gate incisions for forming, in part, an inward travel stop feature associated with the spout of the present invention.

With continued reference to FIG. 1, and referring to FIG. 1*b*, an inward travel stop tab 110 is associated with and carried by the external pouring spout component 86, specifically the center tab 88 thereof. The stop tab 110 is defined by a first, straight cut 112 cut partially through the thickness of the side wall 6 on the inside surface of the blank 2 and parallel to the fold line 20. Upper and lower short angled cuts 114, 116, respectively, connect the ends of the straight partial cut 112 and the fold line 20. The term "partial" is intended to describe a cut which only partially penetrates the thickness of blank 2 (and, thus, the walls forming the carton body). Cut lines 112, 114, 116 are partial cuts, penetrating part way into the paperboard forming the blank 2 (side wall 6) to a depth of from 50 to 60 percent of the thickness of the blank 2. As will be explained below, the partial cut lines, 112, 114, 116 create a delaminating region basically congruent or co-existent with the stop tab 110 which, upon opening of the spout as explained below, delaminates or separates from the inside of the side wall 6 of the carton to form the tab 110.

Referring to FIG. 1 and FIG. 1*a*, the tamper evidence tab 120 of the present invention (see also FIG. 6) is defined in part by cuts on the inside surface of the blank 2 and partially through the end wall 18. The partial cuts include a lower cut 122 generally parallel with the free edge 96 of the center tab 88 and two angled end cuts 124. The upper portion 123 of the tamper evident tab 120 includes a free edge 126 and a parallel partial cut 128 in the inside surface of the blank 2. The free edge 126 and the partial cut 128 are connected by angled free edges 130 and angled partial cuts 132. The partial cuts 122, 124 and 128, 132 associated with the tamper evident tab 120 should penetrate the paperboard forming the blank 2 to a lesser extent than the partial cuts associated with the stop tab 110, penetrating the blank material from about 30 to 40 percent of the thickness of the blank 2.

Figure 4:
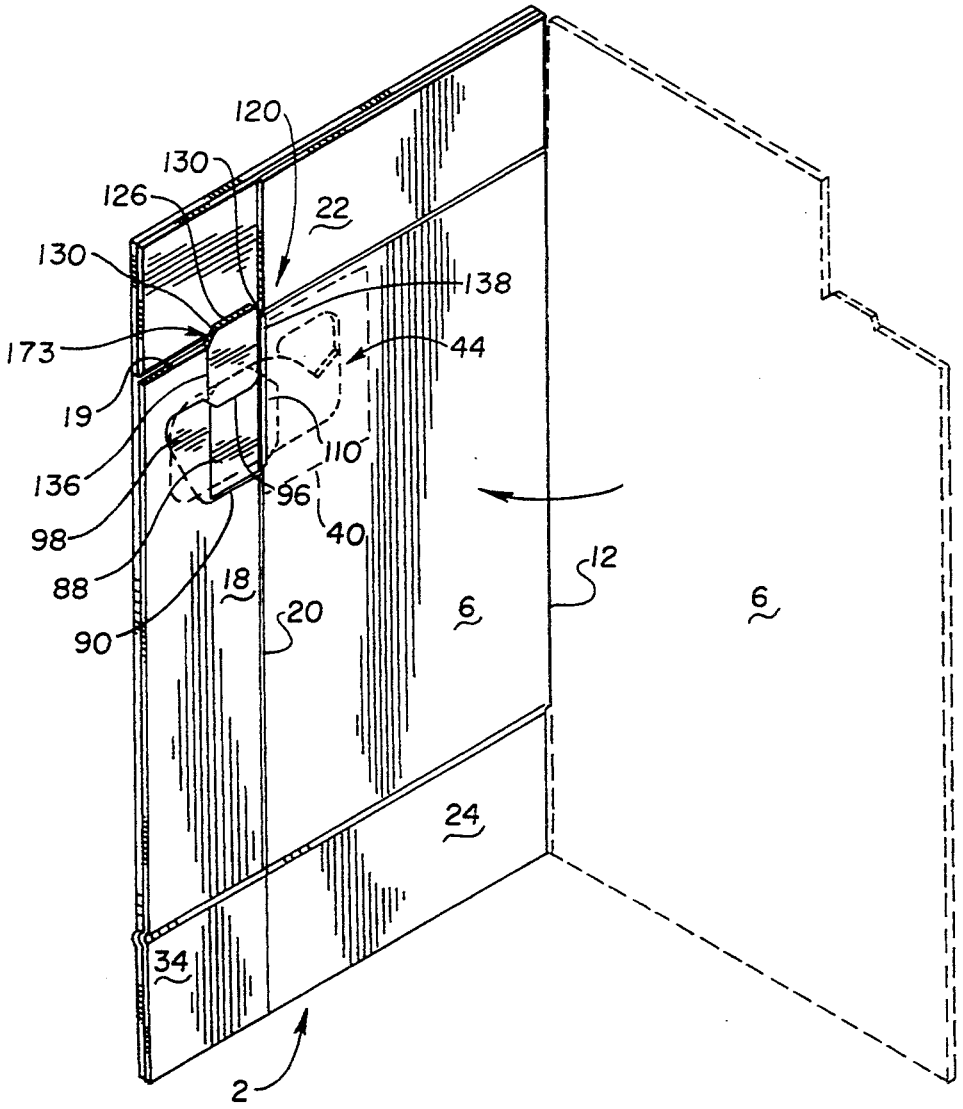
FIG. 4 is a perspective view showing a second fold in the forming of the carton.

Referring to FIG. 4, wherein the opposite or exterior side of the blank 2 is visible, the tamper evident tab 120 is completed by two parallel partial cuts 136, 138. These two cuts 136, 138 penetrate the thickness of the blank 2 from about 50 to 60 percent and at one end, are connected to the cut edge 96 forming the top of the central tab 88. At their upper end, the partial cut lines 136, 138 are connected to the ends of the angled free edges 130, terminating at the free edge 19 of the panel 18. With continued reference to FIG. 4, the partial cut line 138 defining one side edge of the tamper evidencing tab 120 continues downwardly continuously along the fold line 20 to the hinge base 90 to assist in creating the delaminating stop tab 110 on the inside of the blank 2.

Figure 2:
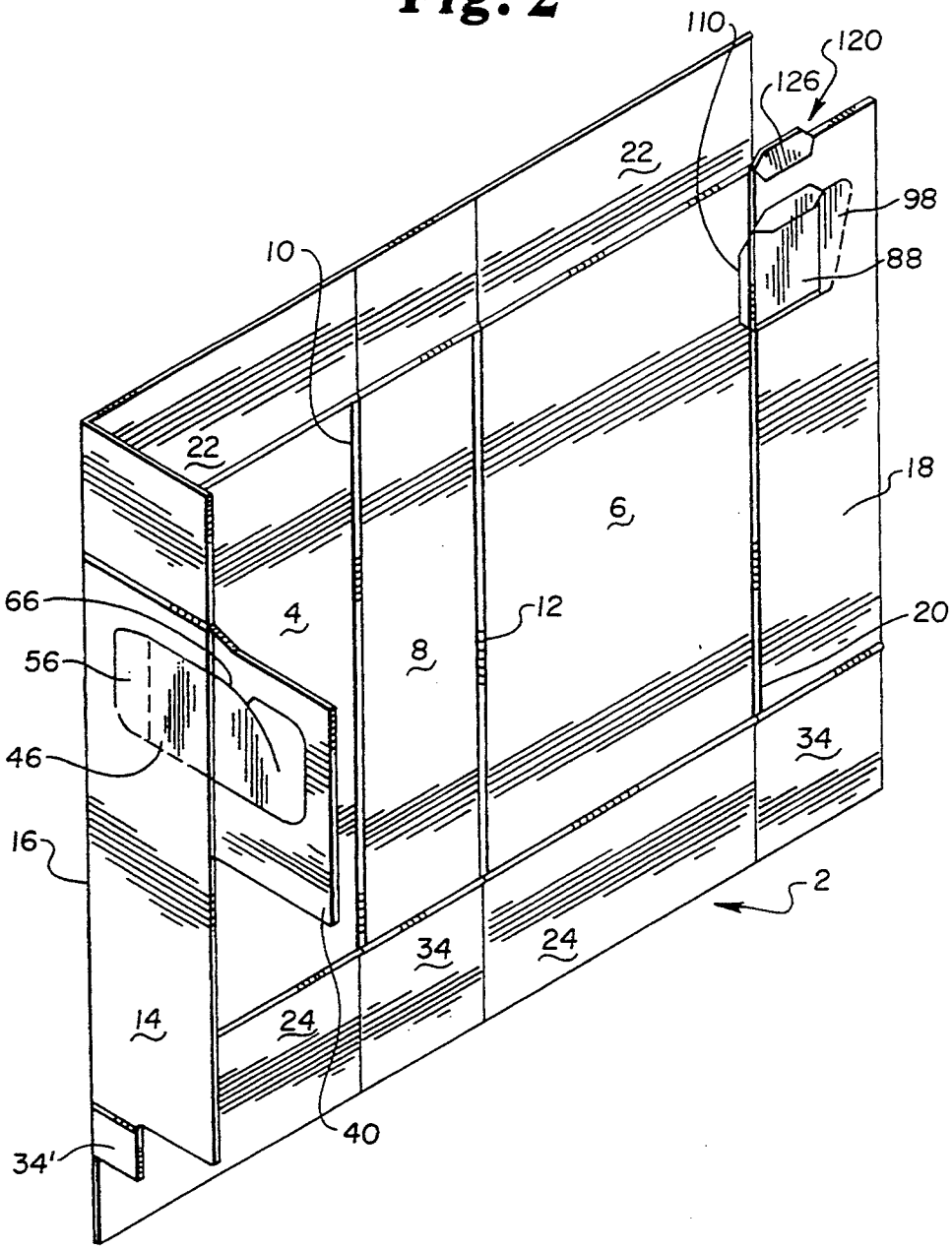
FIG. 2 is a perspective view showing an initial fold in the forming of the carton of the present invention.
Figure 3:
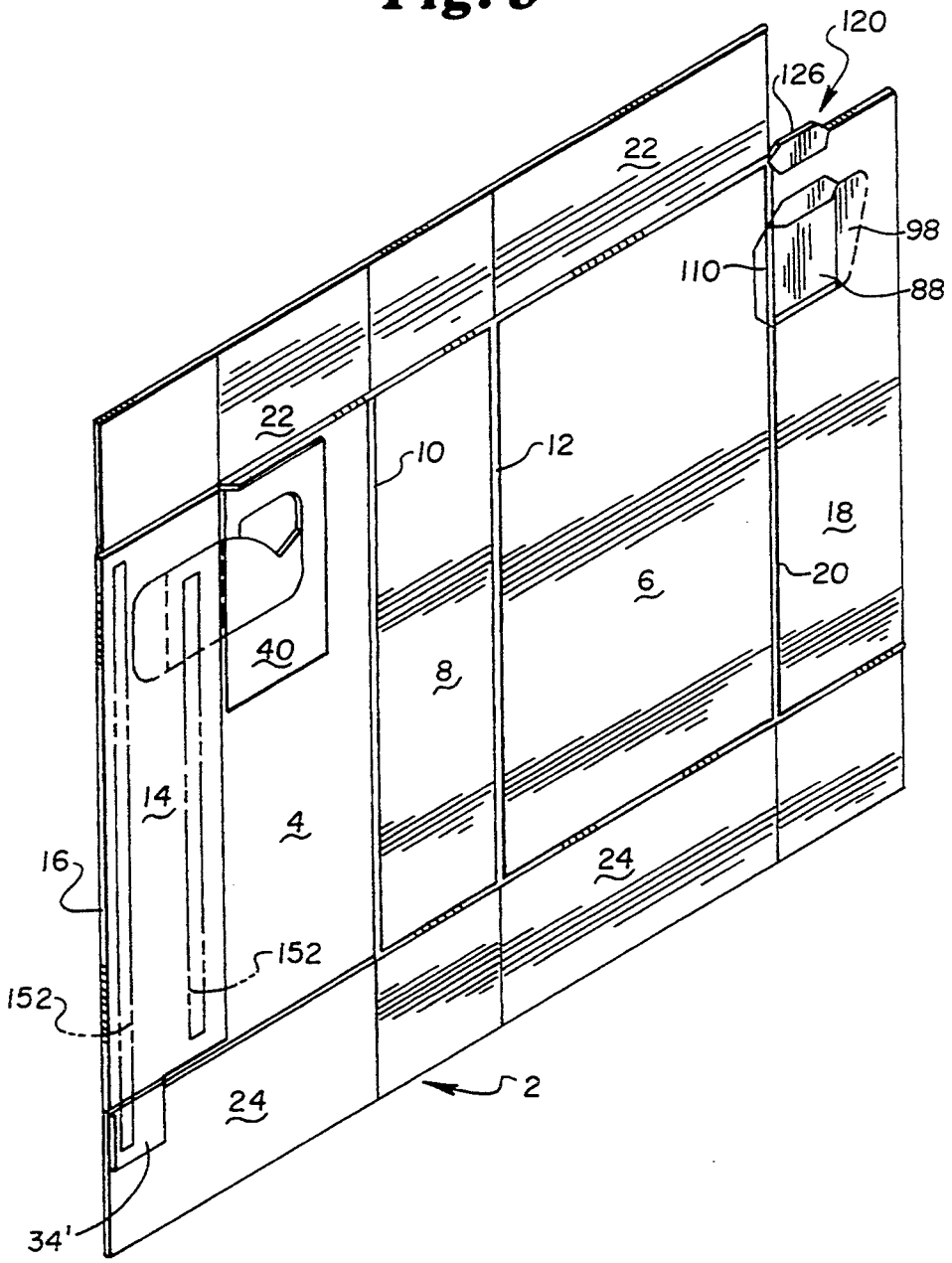
FIG. 3 is a perspective view showing the initial fold completed.

FIGS. 2–5 depict selected steps in the erection or fold up sequence of blank 2 to form the carton 150 of the present invention (depicted fully formed in FIG. 6). As depicted in FIG. 2, the glue panel 14 and extension panel 40 are first folded about the fold line 16 into the close, parallel, overlapping relationship with the side wall panel 4 as depicted in FIG. 3. Next, as shown in FIG. 4, the blank 2 is folded about the fold line 12 so that the main side wall panels 4, 6 are in close parallel overlapping relation and so that the end wall panel 18 is in contact with the glue flap 14. In this position, the extension panel 40 is in contact with the second main side wall panel 6. Also, in this position, the interior pouring spout component 44, particularly the center portion 46 thereof, is aligned with and generally under the exterior pouring spout component 86, particularly the center tab 88. The blank 2 is secured or held in this position by previously applied glue or other adhesive means applied in the adhesive strip areas 152 depicted in FIG. 3.

Figure 5:
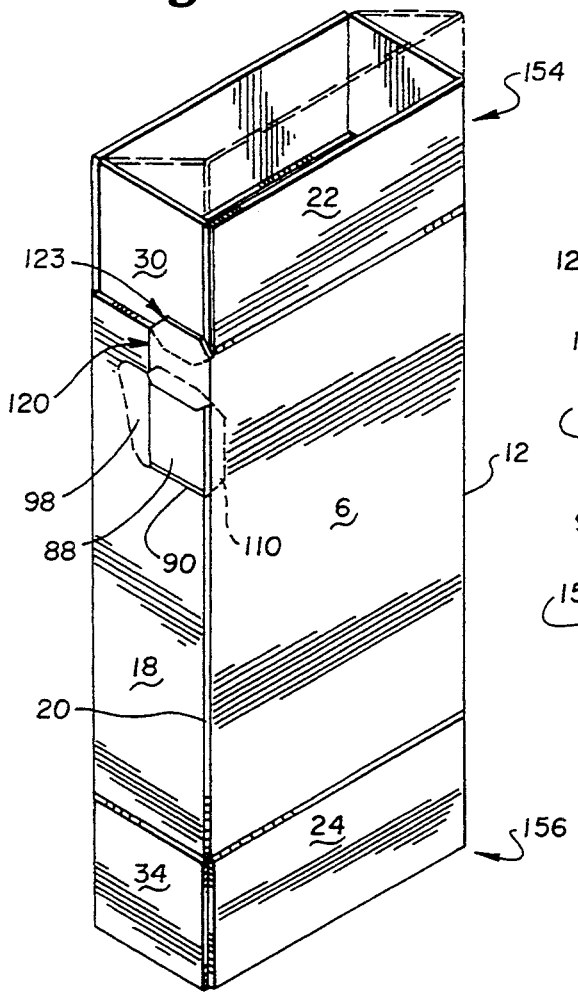
FIG. 5 is a perspective view showing the tubed blank of the carton of the present invention.

In the condition depicted in FIG. 4, the partially folded blank can be shipped to a user who will erect it by "tubing" it, as shown in FIG. 5. The major and minor top and bottom closure panels, indicated generally at 154, 156 in FIG. 5, are folded inwardly one after the other and secured by appropriate means (adhesive, slot and tab arrangements, or the like), whereby a fully erected, sealed carton 150 of substantially rectangular shape is formed as depicted in FIG. 6. The dispensing spout, indicated generally at 158 in FIG. 6, is held closed by the tamper evident tab 120 and the nicks 106.

Figure 7:
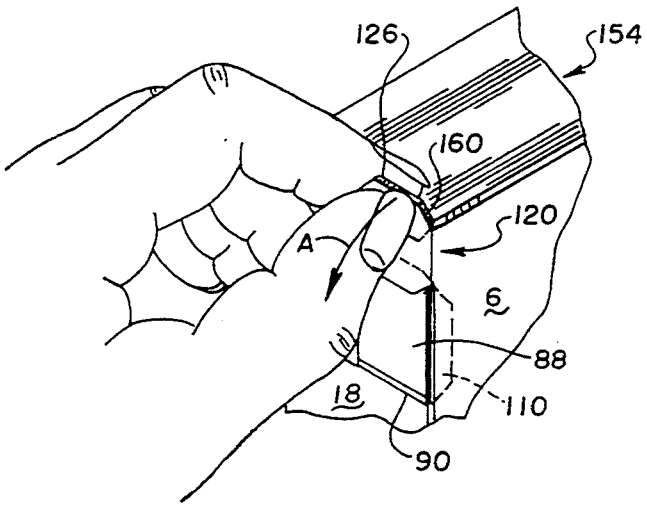
FIG. 7 is a perspective view depicting an initial step in opening-the carton of the present invention, namely, the removal of the tamper evidencing tab.
Figure 8:
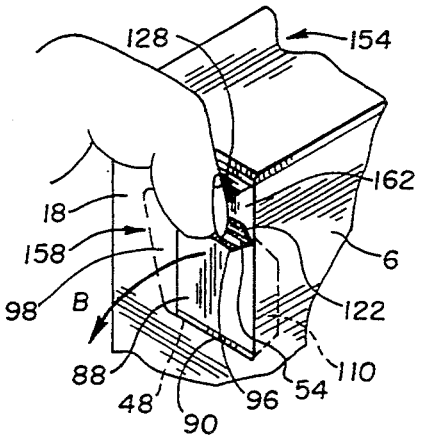
FIG. 8 is a perspective view depicting a subsequent step in opening the spout of the carton of the present invention.
Figure 9:
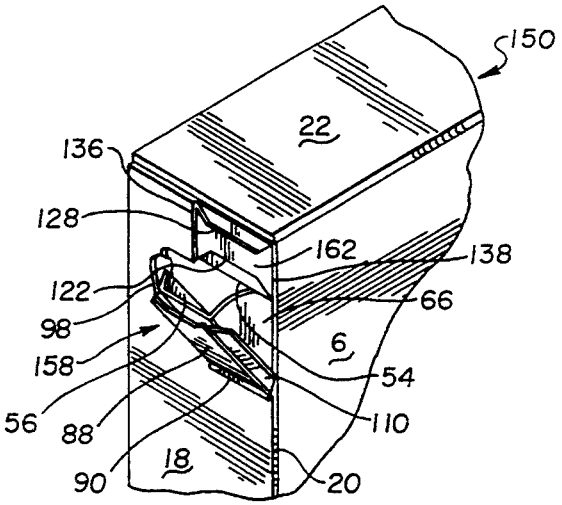
FIG. 9 is a perspective view depicting the spout open and ready to dispense contents, and also revealing the inward movement stop tab feature of the present invention.
Figure 10:
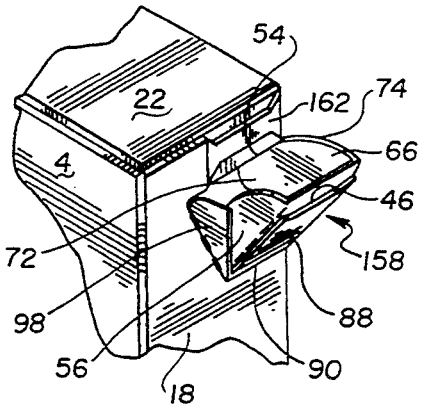
FIG. 10 is a perspective view depicting the outward movement stop feature of the carton of the present invention, and the cooperation of the internal and external spout components of the present invention.
Figure 11:
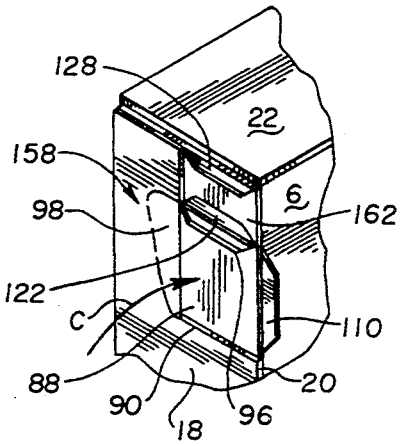
FIG. 11 is a perspective view depicting the carton of the present invention reclosed, and showing the inward movement stop tab abutting the carton body to control the inward movement of the spout.

FIGS. 7 and 8 are fragmentary perspective views illustrating the opening of the carton 150, particularly the opening of the pouring spout 158. With reference to FIG. 7, the tamper evidencing tab 120, particularly the uppermost portion 123 thereof, forms an upstanding, graspable pull tab 160 defined by the free edge 126 which allows the tab 160 to stand up when the carton top closure flaps 154 are folded, is grasped and pulled away from the end wall panel 18 in the direction of arrow "A". As is visible in FIGS. 9–11, removal of the tab 120 and the resultant delamination of the delaminating region of the end wall 18 formed by the partial cut lines identified above, creates a bridge structure 162. The bridge structure 162 is formed by the region of the side wall 18 left when the tamper evidence tab 120 is removed, specifically the area between the upper and lower partial cut lines 128, 122. The bridge structure 162 serves to maintain the integrity and structure of the upper region of the carton 150 after the tamper evident tab 120 is removed.

Referring to FIG. 8, removing the tab 120 creates a space between the bottom of the bridge 162 and the upper edge of the pouring spout 158, specifically the upper free edge 54 of the central part 46. A finger may be used to contact or grasp the top of the pouring spout 158, and the top of the spout 158 is pulled outwardly in the direction of arrow "B", causing the spout 158 to pivot about the superimposed hinge lines 48, 90. The spout 158 is thus extended to the open position shown in FIGS. 9 and 10.

With continued reference to FIG. 8, the function of the inward travel stop tab 110 can be appreciated. As the spout 158 is being opened, the partial cut lines on the inside of the blank 2 defining the inward travel stop tab 110 cause the delamination of delaminating region comprising the tab 110. As the spout 158 is moved to the position depicted in FIG. 9, the stop 110 moves out from under the main side wall 6 with the spout 158 until the bottom edge of the tab 110 clears the fold line 20. The natural resiliency of the material from which the carton of the present invention is formed, and the resiliency created by the tension in that material along the fold line 20, cause the stop 110 to extend outwardly from the spout 158 becomes coplanar or nearly coplanar therewith.

As the spout 158 is being pulled out to its fully opened position, the wings, including the smaller wing 56 and the large wing 66, fold about fold lines 50, 52, respectively, and enable a complete pouring spout 158. One spout side wall is formed by the larger wing 66 and the other by the cooperation of the combined small wing 56 and the exterior supplemental wing 98. As the spout 158 is opened, the irregular upper edge 74 of the large wing 66 follows the edge formed by cut line 54 which defines the free edge of the center part 46 and, thus, the top of the dispensing opening, until reaching the point 76 wherein the angled, catch V-shaped portion of the stop lobe 72 prevents further outward movement of the spout 158.

After a sufficient amount of contents has been dispensed, the user merely pushes (in the direction of arrow "C" of FIG. 11) the upper, free edge of the pouring spout 158 inwardly toward the carton interior. The stop tab 110 delaminated from the inside of the main side wall 6 will abut the corner of the carton formed along the fold line 20 to prevent inward movement past the point at which the spout 158 is generally coplanar with the end wall 18 of the carton 150, thereby ensuring that the spout 158 can be re-opened easily and is not damaged by being pushed too far into the carton. The space between edge 96 and the cut line 122 forming the lower edge of the bridge 162, although closed by the upper region of the center part 46 when the spout 158 is closed (thereby preventing leakage), facilitates re-opening the spout 158.

A number of variations of the present invention can be made. For example, the size of the carton 150 may be varied as may the size of the pouring spout 158. The carton including the pouring spout 158 of the present invention could be produced in cylindrical or other shapes. The preferred material for the carton 150 of the present invention is paperboard, but other suitable material may be used for all or a portion of the invention. The carton 150 may carry indicia, graphics or printing including instructions for opening and reclosing the spout, and it may be overwrapped with appropriate material.

It is contemplated that additional changes, including those mentioned above, can be made without deviating from the spirit of the present invention. Therefore, it is desired that the foregoing description be considered as illustrative, not restrictive, and that reference be made to the appended claims to indicate the scope of the invention.

What is claimed is:

1. A carton comprising:

a carton body;

a movable pouring spout associated with said body;

a first delamination region in said carton body adjacent to the spout; and a second delamination region in said carton body adjacent to the spout.

2. The carton according to claim 1, wherein said delamination regions are defined at least in part by cuts made partially through said carton body.

3. The carton according to claim 2, wherein said cuts include cuts partially penetrating said carton body from one side and other separate cuts partially penetrating said carton body from the other side.

4. The carton according to claim 3, wherein said first delaminating region creates a stop when delaminated, said stop carried by the spout for limiting the movement of the spout.

5. The carton according to claim 4, wherein, when delaminated, said second delaminating region creates a tamper evidence tab removably connected to the carton body and the spout before the spout is moved.

6. The carton according to claim 5, wherein said spout carries a second stop.

7. A pouring spout for a carton having a carton wall, said pouring spout comprising:

a divided external pouring spout component formed in and movably connected to said carton wall for forming a dispensing opening, said external pouring spout component including a stop for limiting the movement thereof; and an internal pouring spout component inside said carton wall, movable through said dispensing opening from a closed to an open position and comprising:

a center part having a base and sides, said center part superimposed by at least a portion of said external pouring spout component; and a first wing hingedly attached to and extending from one of said center part sides and a second wing hingedly attached to and extending from the other of said center part sides, said first wing defining one side of said pouring spout, said second wing being relatively smaller than said first wing and underlying at least a portion of said external pouring spout component.

8. The pouring spout according to claim 7, wherein said stop is formed by a delaminating region of said carton wall.

9. The pouring spout according to claim 8, wherein said delaminating region is formed by cuts made partially through said carton wall.

10. The pouring spout according to claim 8, wherein said delaminating region is connected to said external pouring spout component.

11. The pouring spout according to claim 10, wherein said carton includes a tamper evidence tab adjacent to said external pouring spout component.

12. The pouring spout according to claim 11, wherein said tamper evidence tab includes a free edge and a second edge generally opposite and parallel to said free edge, said second edge releasably connected to said external pouring spout component.

13. The pouring spout according to claim 12, wherein said tamper evidence tab is defined in part by cuts made partially through said carton wall generally between said free and second edges.

14. A recloseable pouring spout for integration and use with dispensing cartons having a wall including at least one double thickness wall area comprising an inside wall and an outside wall, said spout comprising:

an external pouring spout component formed in and hingedly connected to the outside wall and defining a dispensing opening having a top and a bottom therein, said component being split into at least two portions;

a tamper evidence tab adjacent to said external pouring spout component;

an interior pouring spout component formed in the inside wall and being movable through said dispensing opening from a closed to an open position and comprising:

a center part having a base and two sides, hingedly connected at the base to the inside wall and superimposed by at least a portion of said external pouring spout component, and a first wing hingedly attached to and extending from one of said center part sides and a second attached to and extending from the other of said center sides, said first wing defining one side of said pouring spout, said second wing being relatively smaller than said first wing and underlying at least a portion of said external pouring spout component, said first and second wings and said external pouring spout component providing said recloseable pouring spout with spout side walls from the top to the bottom of said dispensing opening.

15. The pouring spout according to claim 14, wherein said carton tamper evidence tab is formed in said outside wall and is defined by a free edge, a second edge generally opposite and parallel to said free edge, and cut lines in said carton wall generally between said free and second edges.

16. The carton according to claim 15, wherein said external pouring spout component is split by a cut line.

17. The pouring spout according to claim 15, said external pouring spout component secured to said center part so that the external pouring spout component and the center part move together relative to the carton wall.

18. The pouring spout according to claim 17, said first wing including an outward travel stop.

19. The pouring spout according to claim 18, further comprising an inward travel stop carried by said external pouring spout component.

20. A carton including an integral pouring spout, said carton comprising:

first and second side wall panels each having two parallel side edges;

a first end wall panel between and hingedly connected to said side wall panels along one of said side edges of each side wall panel;

a second end wall panel hingedly connected to the remaining side edge of said first side wall panel;

top and bottom closure flaps hingedly connected to said side and end wall panels;

a glue flap hingedly connected to the remaining side edge of said second side wall panel, said glue flap being secured to said second end wall panel, whereby said side and end walls form a body wall of a tubular carton body;

an external pouring spout component formed in and movably connected to said second end wall panel, said external pouring spout component including an inward travel stop tab and defining a dispensing opening having a top and a bottom;

an internal pouring spout component formed substantially in said glue flap, said internal pouring spout component being movable through said dispensing opening in said second end wall panel from a closed to an open position and comprising:

a generally rectangular center part having a base and two sides and being hingedly connected at said base to said glue flap and located immediately under and superimposed by at least a portion of said external pouring spout component; and a first wing hingedly attached to and extending from one of said center part sides and a second wing hingedly attached to an extending from the other of said center part sides, said first wing being dimensioned to completely close one side of said dispensing opening, said second wing being relatively smaller than said first wing, said second wing underlying at least a portion of said external pouring spout component, said external pouring spout component and said first and second wings providing said integral pouring spout with side walls from the top to the bottom of said dispensing opening when said internal pouring spout component is in said open position.

21. The carton according to claim 20 inward travel stop tab comprising a delaminated region of said first side wall panel defined in part by cut lines cut partially through the first side wall panel.

22. The carton according to claim 21, said delaminated region connected to said external pouring spout component.

23. The carton according to claim 22, including a tamper evidence tab adjacent to said external pouring spout component.

24. The carton according to claim 23, said tamper evidence tab including a free edge, a second edge generally opposite and parallel to said free edge and a delaminated region generally between said free and second edges, said second edge releasably connected to said external pouring spout component.

25. The carton according to claim 24, wherein said tamper evidence tab is defined in said second end wall panel in part by cuts partially cut through said second end wall panel.

26. The carton according to claim 25, wherein said tamper evidence tab is located above and immediately adjacent to said external pouring spout component, and is removably attached to said second end wall panel and to said external pouring spout component to prevent said integral pouring spout from being opened until said tamper evidence tab is removed.

27. A foldable one-piece blank for forming a carton having an integral pouring spout formed therein, said blank comprising:

generally rectangular first and second side wall panels each having two parallel side edges;

a first end wall panel between and hingedly connecting said side wall panels along one of said two parallel side edges of each side wall panel;

a second end wall panel hingedly connected to the remaining edge of said first side wall panel;

top and bottom closure flap panels hingedly connected to said side and end wall panels;

a glue flap hingedly connected to the remaining edge of said second side wall panel, said glue flap being designed to be secured to said second end wall panel when said blank is folded to form a body wall of a tubular carton body;

an external pouring spout component formed in and movably attached to said second end wall panel, said external pouring spout component including an inward travel stop tab and defining a dispensing opening having a top and a bottom and being hingedly connected to said second end wall panel;

a pouring spout formed in said glue flap, said spout being movable through said dispensing opening in said second end wall panel from a closed to an pen position when said carton blank is folded to form the carton body, said spout comprising:

a generally rectangular center part having a base and two sides, said center part being hingedly connected at the base to said glue flap and designed to be located immediately under and superimposed by at least a portion of said external pouring pout component when said blank is folded to form the carton body, and a wing hingedly attached and extending to each side of said center part, one of said wings being so dimensioned as to completely close one side of said dispensing opening when said blank is folded to form a carton body, the second of said wings being relatively smaller than the other wing, said second wing being designed to underlie at least a portion of said external pouring spout component, whereby, when said blank is folded to form a carton, said wings and said external pouring spout component provide said pouring spout with side walls from the top to the bottom of said dispensing opening.

28. A carton having a pouring spout, said carton comprising:

a carton body having at least one double thickness wall area and a tamper evidence tab adjacent to said double thickness wall area comprising an inside wall area and an outside wall area;

an external pouring spout component formed in and hingedly connected to said outside wall area and including a center tab and a side wing, said center tab being hinged to said outside wall area along a first axis and said side wing being hinged to said outside wall area along a second axis, said external pouring spout component carrying a stop tab and defining a dispensing opening having a top and a bottom;

an internal pouring spout component formed in said inside wall area and being movable through said dispensing opening from a closed to an open position and comprising:

a center part having a base and a pair of sides and being hingedly connected at said base to said inside wall area and superimposed by at least a portion of said external pouring spout component, and a first wing hingedly attached to an extending from one of said center part sides and a second wing hingedly attached to and extending from the other of said center part sides, said first wing defining one side of said pouring spout and including a stop lobe, said second wing being relatively smaller than said first wing and underlying at least a portion of said external pouring spout component.

29. The carton according to claim 28, wherein said center tab is generally rectangular and said side wing is generally triangular.

30. The carton according to claim 29, wherein said dispensing opening includes a pair of sides, said first wing so dimensioned as to extend along one side of said dispensing opening sides during movement of said pouring spout between said closed and open positions.

31. A foldable one-piece blank for forming a carton having an integral pouring spout formed therein, said blank comprising:

generally rectangular first and second side wall panels each having two parallel side edges;

a first end wall panel between and hingedly connecting said side wall panels along one of said two parallel side edges of each side wall panel;

a second end wall panel hingedly connected to the remaining edge of said first side wall panel and having a tamper evidence tab defined therein;

top and bottom closure flap panels hingedly connected to said side and end wall panels;

a glue flap hingedly connected to the remaining edge of said second side wall panel, said glue flap being designed to be secured to said second end wall panel when said blank is folded to form a body wall of a tubular carton body;

an external pouring spout component formed in and hingedly, movably attached to said second end wall panel, said component including a stop tab and a side wing and defining a dispensing opening having a top and a bottom;

a pouring spout formed in said glue flap, said spout being movable through said dispensing opening from a closed to an open position after said carton blank is folded to form the carton body, said spout comprising:

a generally rectangular center part having a base and two sides, said center part being hingedly connected at the base to said glue flap and designed to be located immediately under and superimposed by at least a portion of said external pouring spout component when said blank is folded to form the carton body, and a wing hingedly attached to and extending from each side of said center part, one of said wings being so dimensioned as to completely close one side of said dispensing opening when said blank is folded to form a carton body and carrying an outward travel stop lobe, the second of said wings being relatively smaller than the other wing, said second wing being designed to underlie at least a portion of said external pouring spout component, whereby, when said blank is folded to form a carton, said wings and said external pouring spout component provide said pouring spout with side walls from the top to the bottom of said dispensing opening.

32. The blank according to claim 31 wherein said stop tab associated with said external pouring spout component is hingedly connected to said external pouring spout component and is removably connected to a side wall at a delamination area defined by cut lines partially cut through said side wall.

33. The blank according to claim 32, wherein said tamper evidence tab is located above and immediately adjacent to said external pouring component tab, said tamper evidence tab being removably attached to said second end wall panel at a delamination area defined by cut lines partially cut through the end wall, and to said external pouring spout component at a nicked-out cut line to prevent opening of said integral pouring spout until said tamper evidence tab is removed.

* * * * *